US007373794B1

(12) United States Patent
DePass

(10) Patent No.: US 7,373,794 B1
(45) Date of Patent: May 20, 2008

(54) LOCK ASSEMBLY

(75) Inventor: Geoffrey S. DePass, Plantation, FL (US)

(73) Assignee: Delta Industrial Systems Corp., Sunrise, FL (US)

( * ) Notice: Subject to any disclaimer, the term of this patent is extended or adjusted under 35 U.S.C. 154(b) by 0 days.

(21) Appl. No.: 11/450,120

(22) Filed: Jun. 9, 2006

Related U.S. Application Data

(60) Provisional application No. 60/692,541, filed on Jun. 21, 2005.

(51) Int. Cl.
*E05B 60/08* (2006.01)

(52) U.S. Cl. ..... 70/99; 70/95; 70/97; 70/100; 292/57; 292/195; 292/203; 292/304; 292/DIG. 46

(58) Field of Classification Search ..... 70/95–97, 70/99–100; 292/4, 24, 57–58, 109, DIG. 46, 292/194–195, 197, 304, 202–203, 336.3
See application file for complete search history.

(56) References Cited

U.S. PATENT DOCUMENTS

| | | | | | |
|---|---|---|---|---|---|
| 604,652 | A | | 5/1898 | Bust | |
| 841,269 | A | | 1/1907 | Pitner | |
| 1,376,141 | A | | 4/1921 | Evans | |
| 1,462,826 | A | | 7/1923 | Rixson | |
| 1,724,630 | A | | 8/1929 | Wilson | |
| 2,038,737 | A | | 4/1936 | Jambrich | |
| 2,581,816 | A | * | 1/1952 | Schlueter | 70/100 |
| 2,638,370 | A | | 5/1953 | Price | |
| 2,666,319 | A | | 1/1954 | Price | |
| 2,862,378 | A | | 12/1958 | Harris | |
| 3,177,687 | A | | 4/1965 | Tucker | |
| 3,390,557 | A | * | 7/1968 | Erickson et al. | 70/97 |
| 3,596,954 | A | * | 8/1971 | Hull et al. | 292/128 |
| 3,877,739 | A | * | 4/1975 | Cowen | 70/100 |
| 3,899,201 | A | * | 8/1975 | Paioletti | 70/100 |
| 4,024,739 | A | * | 5/1977 | Kaufman | 70/97 |
| 4,103,946 | A | | 8/1978 | Tipler | |
| 4,434,635 | A | | 3/1984 | Borgato | |
| 4,691,948 | A | | 9/1987 | Austin, Jr. et al. | |
| 4,790,157 | A | * | 12/1988 | Lin | 70/95 |
| 5,092,144 | A | | 3/1992 | Fleming et al. | |
| 5,474,342 | A | | 12/1995 | Smith et al. | |
| 5,526,659 | A | * | 6/1996 | Takimoto | 70/99 |
| 5,540,066 | A | * | 7/1996 | Takimoto | 70/99 |
| 5,820,170 | A | | 10/1998 | Clancy | |
| 5,951,068 | A | | 9/1999 | Strong et al. | |
| 6,022,056 | A | | 2/2000 | Cope et al. | |
| 6,196,034 | B1 | | 3/2001 | Diebold et al. | |
| 6,209,931 | B1 | | 4/2001 | Von Stoutenborough et al. | |
| 6,264,252 | B1 | * | 7/2001 | Clancy | 292/196 |
| 6,502,435 | B2 | * | 1/2003 | Watts et al. | 70/95 |
| 6,672,632 | B1 | | 1/2004 | Speed et al. | |

(Continued)

*Primary Examiner*—Patricia Engle
*Assistant Examiner*—Christopher Boswell
(74) *Attorney, Agent, or Firm*—D. Peter Hochberg; Sean F. Mellino; Daniel J. Smola

(57) ABSTRACT

A lock assembly for use with a sliding door. The lock assembly includes a non-handed miniature mortise lock having a retractable and extendable tongue able to move between a locked position and an unlocked position. The assembly includes a rotatable spindle and a slidable piece. Manipulation of the slidable piece rotates the rotatable spindle and activates the mortise lock between the locked and unlocked positions.

14 Claims, 10 Drawing Sheets

U.S. PATENT DOCUMENTS 6,679,533 B1 1/2004 Bruner et al.
6,688,656 B1 * 2/2004 Becken ..... 292/26
2003/0226384 A1 12/2003 Shedd et al.
2004/0050119 A1 3/2004 Toulis et al.

* cited by examiner

LOCK ASSEMBLY

CROSS REFERENCE TO RELATED APPLICATION

This application claims priority of U.S. Provisional Application No. 60/692,541, filed Jun. 21, 2005, under Title 35, United States Code, Section 119(e).

BACKGROUND OF THE INVENTION

1. Field of the Invention

The present invention relates generally to locks and locking assemblies. More particularly, the present invention relates to an improved locking assembly suitable for the locking of a sliding door.

2. Description of the Prior Art

Locks generally used in conjunction with a sliding door typically include a locking element having a beak or tongue which hooks into an opening on a corresponding latch, strike or keeper. Such types of locks can be fairly easy to overcome and often times provide little resistance to unauthorized entry through the sliding door or unauthorized unlocking of the lock itself.

Another problem often associated with locks for sliding doors is the tongue may be in an extended, or locked, position while the door itself is open or ajar. The door may be inadvertently closed while the tongue is extended, thereby causing damage to any one or more of the door, the tongue, the lock as a whole or the adjacent keeper. This can result in the undesirable and potentially expensive repair, or even replacement, of any one or more of the aforementioned components.

Referring first to FIGS. 1 and 2, an example of a prior art locking assembly used in conjunction with sliding doors is shown and described. FIGS. 1 and 2 show an interior escutcheon or latch 11 in a prior art locking assembly 10 for use with a sliding door (not shown). The interior escutcheon 11 includes a movable locking element 12. The locking element 12 is shown in greater detail in FIG. 2.

Locking element 12 includes a locking portion 13 and is movable in an upwardly and downwardly direction for the locking and unlocking of locking assembly 10 in response to movement of a control switch 14. Upon activation in a downwardly direction, locking element 12 secures onto an opening in an adjacent keeper (not shown) to secure the locking assembly and to lock the door. This prior art locking assembly also includes a backup lock 16 for providing additional support to the locking elements as needed or desired, such as at night, or if the house, building, etc. will be vacant for an extended period of time. However, as noted above, one problem with such prior art locking assemblies is that the locking elements can be fairly easily disengaged from the keeper to unlock the door in an unauthorized manner, or can be forced open in a relatively simple manner, even if the backup is activated.

Therefore, there is a need for an improved locking assembly suitable for use with a sliding door and that can easily and inexpensively replace the prior art locking assembly already in place with the sliding door to be locked.

SUMMARY OF THE INVENTION

According to one broad aspect of the present invention, there is provided a locking assembly incorporating the use of a modified miniature mortise lock for use with a sliding door.

It is an object of the present invention to provide an improved locking assembly incorporating the use of a modified miniature mortise lock for use on a sliding door.

Another object of the present invention is to provide an improved locking assembly having a modified miniature mortise lock that is adjustable.

Yet another object of the present invention is to provide an improved locking assembly having a modified miniature mortise lock that does not require cams having different lengths.

Still yet another object of the present invention is to provide an improved locking assembly having a retractable tongue for preventing damage to the mortise lock and/or to the adjacent door stile due to improper closing of a sliding door.

It is an additional object of the present invention to provide an improved locking assembly that is stronger and more durable than conventional locking assemblies for use with sliding doors.

It is yet another object of the present invention to provide a locking assembly that provides greater resistance to unauthorized unlocking of the locking assembly for use with a sliding door.

A further object of the present invention is to provide an improved locking assembly that easily replaces a conventional locking assembly that is in use with a sliding door.

Another object of the present invention is to provide an improved locking assembly that inexpensively replaces a conventional locking assembly that is in use with a sliding door.

Yet another object of the present invention is to provide an improved locking assembly employing the use of a six-sided spindle for activating the modified miniature mortise lock.

Still yet another embodiment of the present invention is to provide an improved locking assembly employing the use of a non-handed modified miniature mortise lock.

Other objects will become apparent from the description to follow and from the appended claims.

DETAILED DESCRIPTION OF THE PREFERRED EMBODIMENTS

Figure 1:
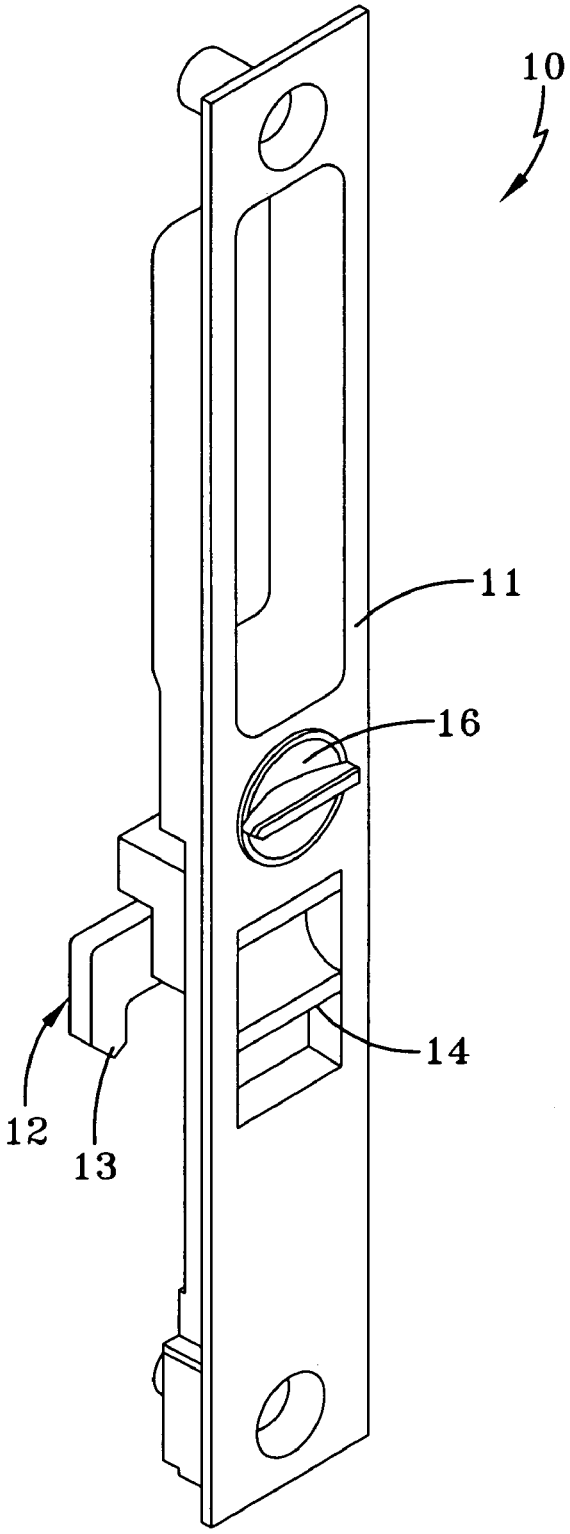
FIG-1 PRIOR ART
FIG. 1 is a perspective view of a prior art lock assembly.
Figure 2:
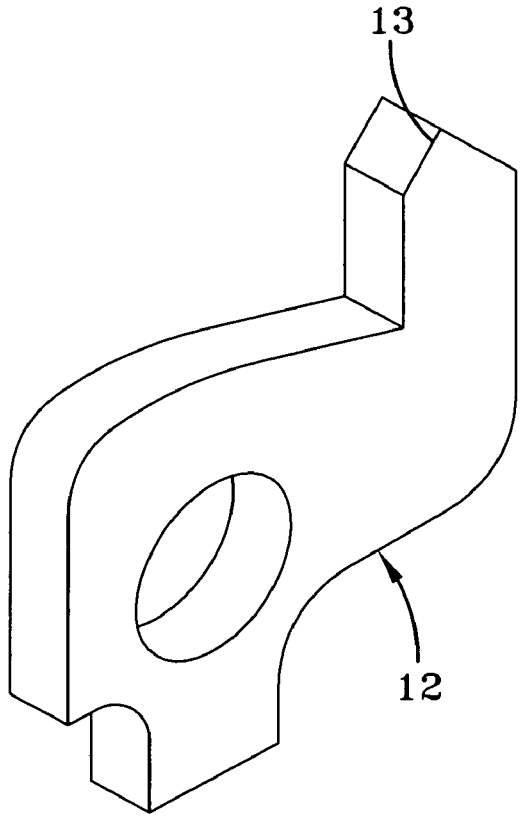
FIG-2 PRIOR ART
FIG. 2 is a perspective view of the locking element of the prior art lock assembly as shown in FIG. 1.
Figure 3:
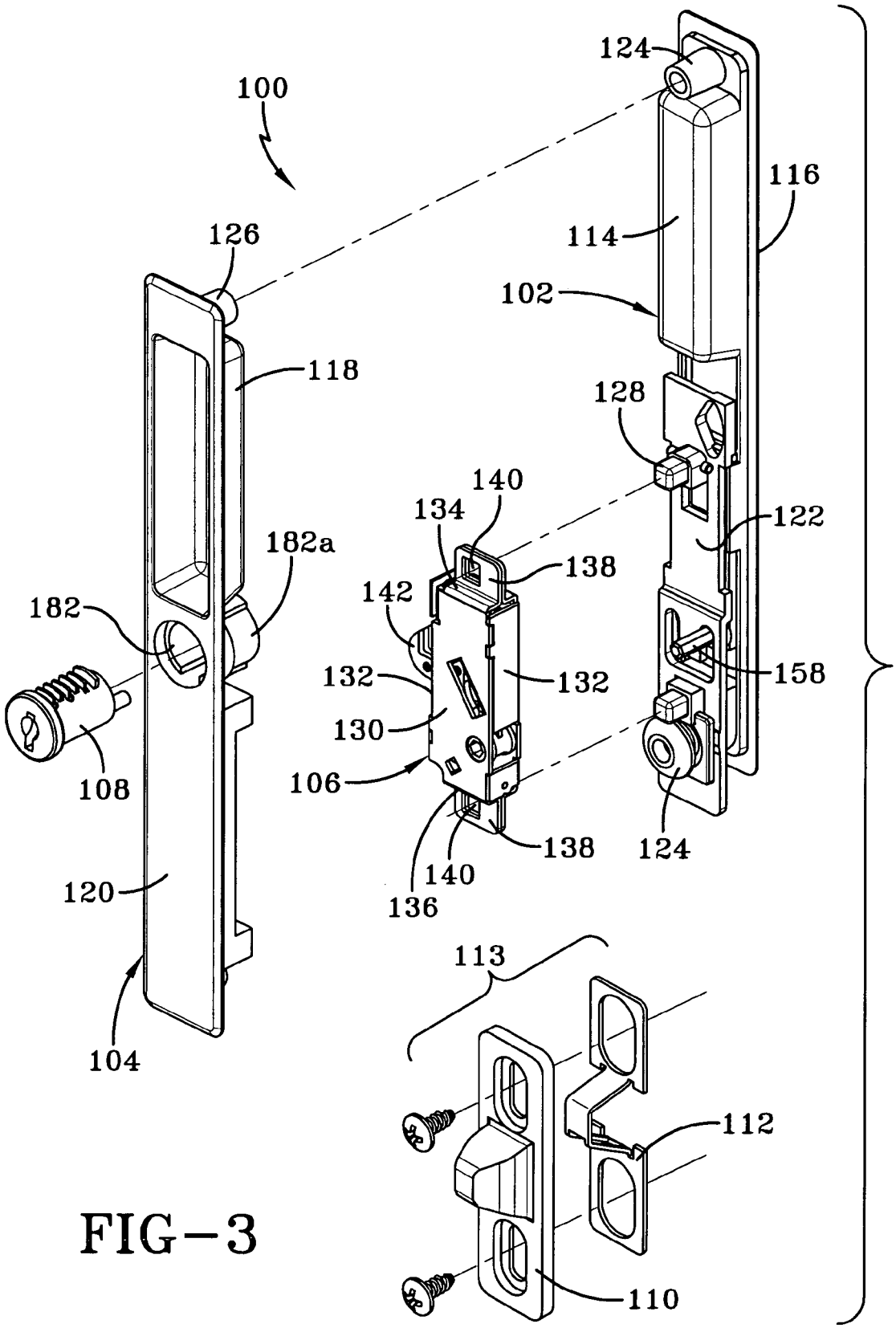
FIG. 3 is an exploded view of the lock assembly according to the present invention.

The fundamental components of a lock assembly 100 for a sliding door are shown in FIG. 3. Lock assembly 100 includes an interior escutcheon or latch 102, an exterior escutcheon or latch 104 and a mortise lock 106. It should be appreciated that relative to a door stile (not shown in FIG. 3) onto which assembly 100 is secured, i.e., a door stile for a sliding door leading into a house, interior escutcheon 102 is the portion of assembly 100 facing into the house and exterior escutcheon 104 is the portion of assembly 100 facing the external environment or outside the house. It should also be appreciated that assembly 100, and the components thereof as explained below, generally comprises any material conventional in the art, such as brass or steel.

Interior escutcheon 102 further includes an interior facing 114, an exterior protective facing 116 and a slidable device, such as a slider piece 122, fitted between interior escutcheon 102 and exterior escutcheon 104. Slider piece 122 is vertically slidable or movable when assembly 100 is in operation. Exterior escutcheon 104 further includes an interior facing 118 facing towards interior escutcheon interior facing 114 and an exterior protective facing 120. Exterior escutcheon exterior facing 120 may be comprised of any strong, sturdy material resistant to tampering, breaking or any other form of unauthorized access common in the art, such as steel or brass. Assembly 100 further comprises a wafer or key cylinder 108, a keeper 110 and a keeper's bracket 112. Exterior escutcheon 104 further comprises a key cylinder receiving hole 182 having an annular sidewall 182*a* for receiving key cylinder 108 in a secure engagement.

Figure 4A:
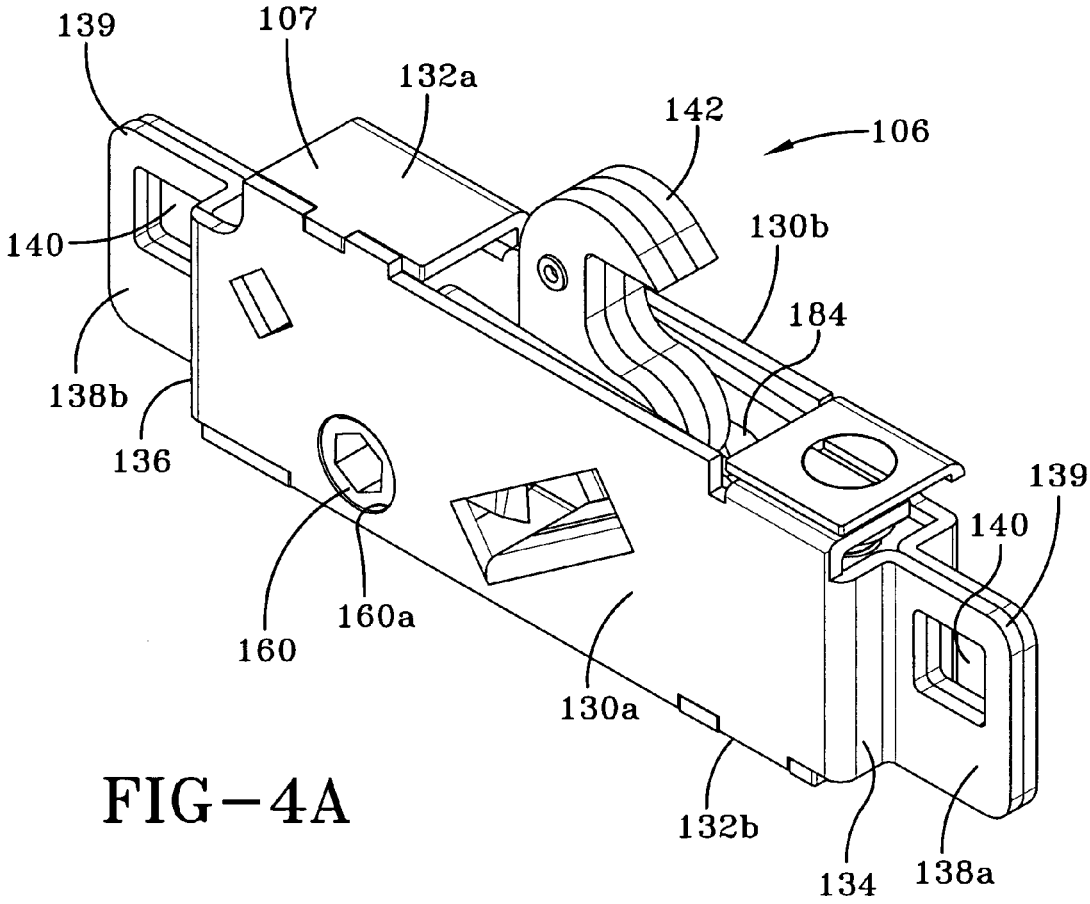
FIG. 4A is a perspective view of the mortise lock of the lock assembly as shown in FIG. 3.
Figure 4B:
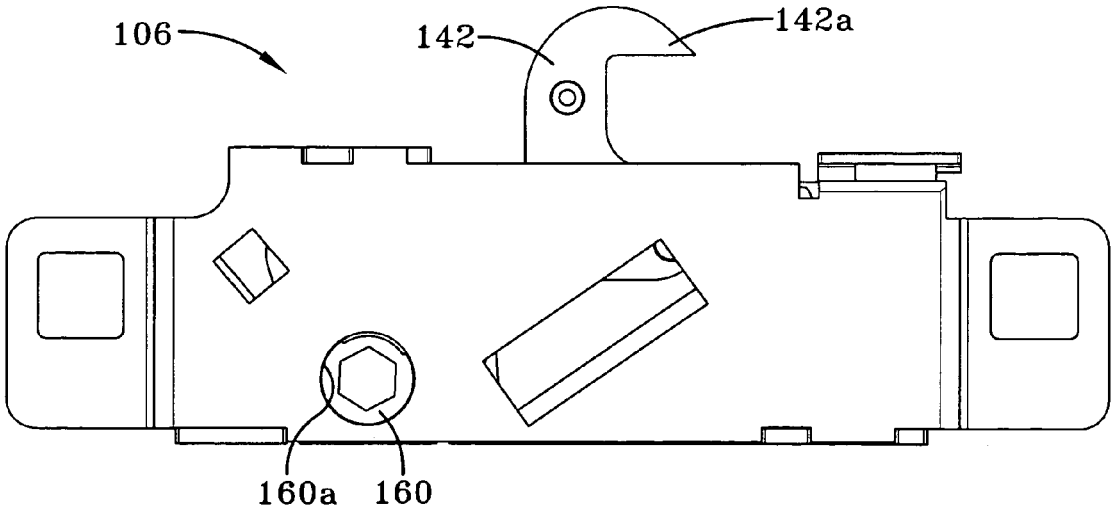
FIG. 4B is a side view of the mortise lock as shown in FIG. 4A.

Referring now to FIGS. 4A and 4B, mortise lock 106 is shown and described in greater detail. It should be appreciated that mortise lock 106 is not a standard-sized mortise lock common in the art, but is a miniature modified mortise lock having a size compatible with assembly 100 for use on a sliding door (not shown). It should also be appreciated that mortise lock 106 will be discussed having a vertical arrangement relative to assembly 100; however, mortise lock 106 is not limited to this arrangement.

Mortise lock 106 comprises a substantially-rectangular shaped housing 107 comprising a top end 134, when mortise lock 106 is vertically arranged, a bottom end 136, two opposing narrow sides 132*a*, 132*b* extending from top end 134 to bottom end 136 and two opposing wide sides 130*a*, 130*b* extending from top end 134 to bottom end 136. Wide sides 130*a*, 130*b* and narrow sides 132*a*, 132*b* are secured to each other at perpendicular angles to form substantially rectangular-shaped mortise lock housing 107. Mortise lock 106 also includes a moveable locking element or tongue 142 that is moveable between a locked position (extended) and an unlocked position (retracted).

Still referring to FIG. 4A, opposing narrow sides 132*a*, 132*b* will be referred to individually as a front side 132*a* and a rear side 132*b*. Front side 132*a* includes an accessible opening 184 for providing tongue 142 with pivotable access into and out of housing 107 and between the locked position (i.e., extended and substantially outside mortise lock 106) and the unlocked position (i.e., retracted and substantially extending inside housing 107). Mortise lock 106 further includes two opposing flanges 138*a*, 138*b* extending upwardly from top end 134 and downwardly from bottom end 136. In other words, when mortise lock 106 is in a vertical arrangement relative to assembly 100, flange 138*a* extends in an upwardly direction from top end 134 and flange 138*b* extends in a downwardly direction from bottom end 136. Flanges 138*a*, 138*b* have substantially the same width as opposing sides 130. Opposing flanges 138*a*, 138*b* are both comprised of a rectangular body 139 defining a rectangular securing hole 140. It should be appreciated that the rectangular shape of flanges 138 and securing hole 140 is but one appropriate configuration of flanges 138 and respective hole 140, and flanges 138 and respective hole 140 may include any shape applicable in the art. It should also be appreciated that opposing flanges 138 may be secured to mortise lock housing 107 by any manner known in the art, such as by rivets, welding, machining, or the like, or can be integrally formed with housing 107 from a single piece of material as housing 107.

Still referring to FIGS. 4A and 4B, a six-sided drive shaft 160 extends through housing 107. It should be appreciated that drive shaft 160 need not be limited to being six-sided, but may have any configuration for engaging with a corresponding spindle (discussed below). Drive shaft 160 is in mechanical communication with locking element 142 via a drive assembly (not shown) for causing the extension and retraction of locking element 142 relative to housing 107. An accessible opening 160*a* is provided on each side of housing 107 for providing access to drive shaft 160. The operation of drive shaft 160 is discussed in further detail below. The drive assembly itself is a typical drive assembly known in the art, and therefore a detailed discussion thereof is omitted for the sake of brevity.

As seen in FIGS. 4A and 4B, locking element 142 includes a securable locking portion or tongue 142*a*. Tongue 142*a* is lockably securable to a keeper assembly 113 (discussed below) when locking element 142 is activated and extended.

Figure 5A:
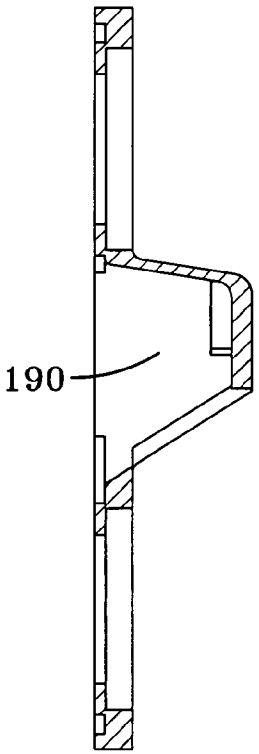
FIG. 5A is a cross-sectional view of the keeper portion of the lock assembly as shown in FIG. 5.
Figure 5:
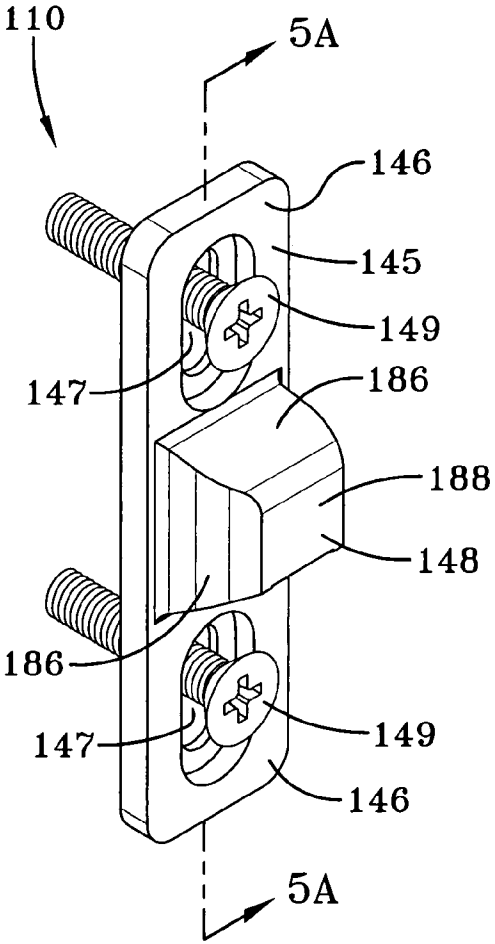
FIG. 5 is a perspective view of the keeper portion of the lock assembly as shown in FIG. 3.

Turning now to FIGS. 5, 5A, 6 and 6A, keeper 110 (FIG. 5) and keeper's bracket 112 (FIG. 6) are secured together to form a keeper assembly 113 (FIG. 3) and are shown and described. Keeper assembly 113 is secured to the interior of a door frame (not shown) opposite from the door stile in which assembly 100 is secured. Keeper 110 includes a substantially rectangular base portion 145 having two opposing ends 146. Each end of opposing ends 146 defines a screw hole 147 for providing access to a screw 149 through keeper 110 for securing keeper assembly 113 (FIG. 3) to the door frame. Keeper 110 further includes a central portion 148 comprised of four angled walls 186 extending outwardly from base portion 145 and converging at an end wall 188 to form a cavity 190 (FIG. 5A). During operation of assembly 100, cavity 190 receives tongue 142*a* in a secure hooking engagement, thereby locking assembly 100 in place and preventing the sliding door from being opened.

Figure 6A:
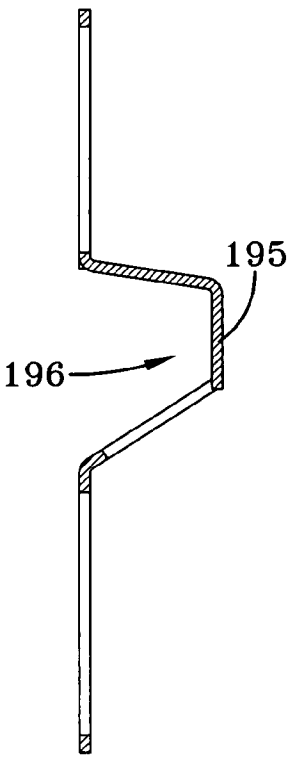
FIG. 6A is a cross-sectional view of the keeper's bracket of the lock assembly as shown in FIG. 6.
Figure 6:
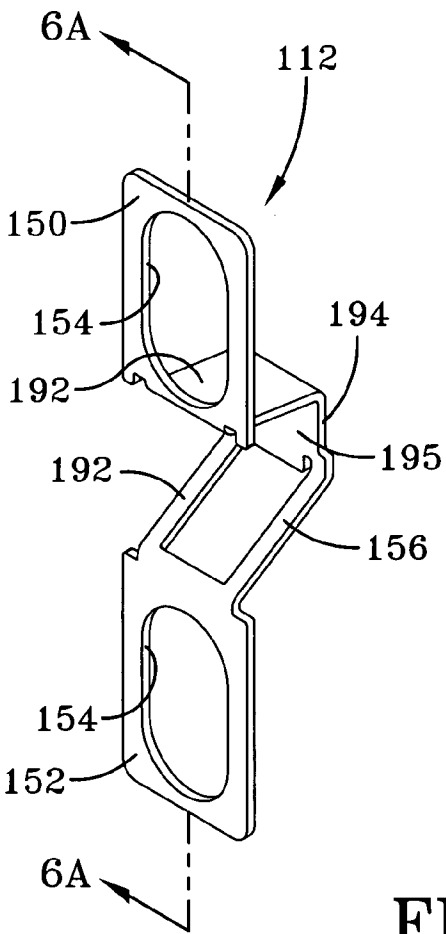
FIG. 6 is a perspective view of the keeper's bracket of the lock assembly as shown in FIG. 3.

As shown in FIGS. 6 and 6A, keeper's bracket 112 includes an upper portion 150, a lower portion 152 and a central portion 156 having two angled sidewalls 192, converging at an end wall 194 to form a central portion 195 defining a keeper bracket cavity 196 (FIG. 6A) and which corresponds to cavity 190. As seen in FIG. 6, one sidewall extends from the bottom end of upper portion 150 and the other sidewall extends from the top end of lower portion 152. A screw hole 154 is provided in each of upper portion 150 and lower portion 152. It should be appreciated that keeper cavity 190 and keeper's bracket cavity 196 have substantially the same shape whereby keeper 110 and keeper's bracket 112 are engageable such that central cavity 195 securely fits into cavity 190 and such that screw holes 154 of keeper's bracket 112 correspond to and align with screw holes 147 of keeper 110. Typically, keeper's bracket 112 is machined from a single piece of material to form the configuration set forth above.

During operation, keeper's bracket 112 and keeper 110 are arranged together in the manner set forth above, and are secured to a corresponding cut-out portion of the door frame (not shown). This arrangement provides keeper assembly 113 with added strength for facilitating locking of assembly 100 and for preventing unauthorized access.

Figure 7A:
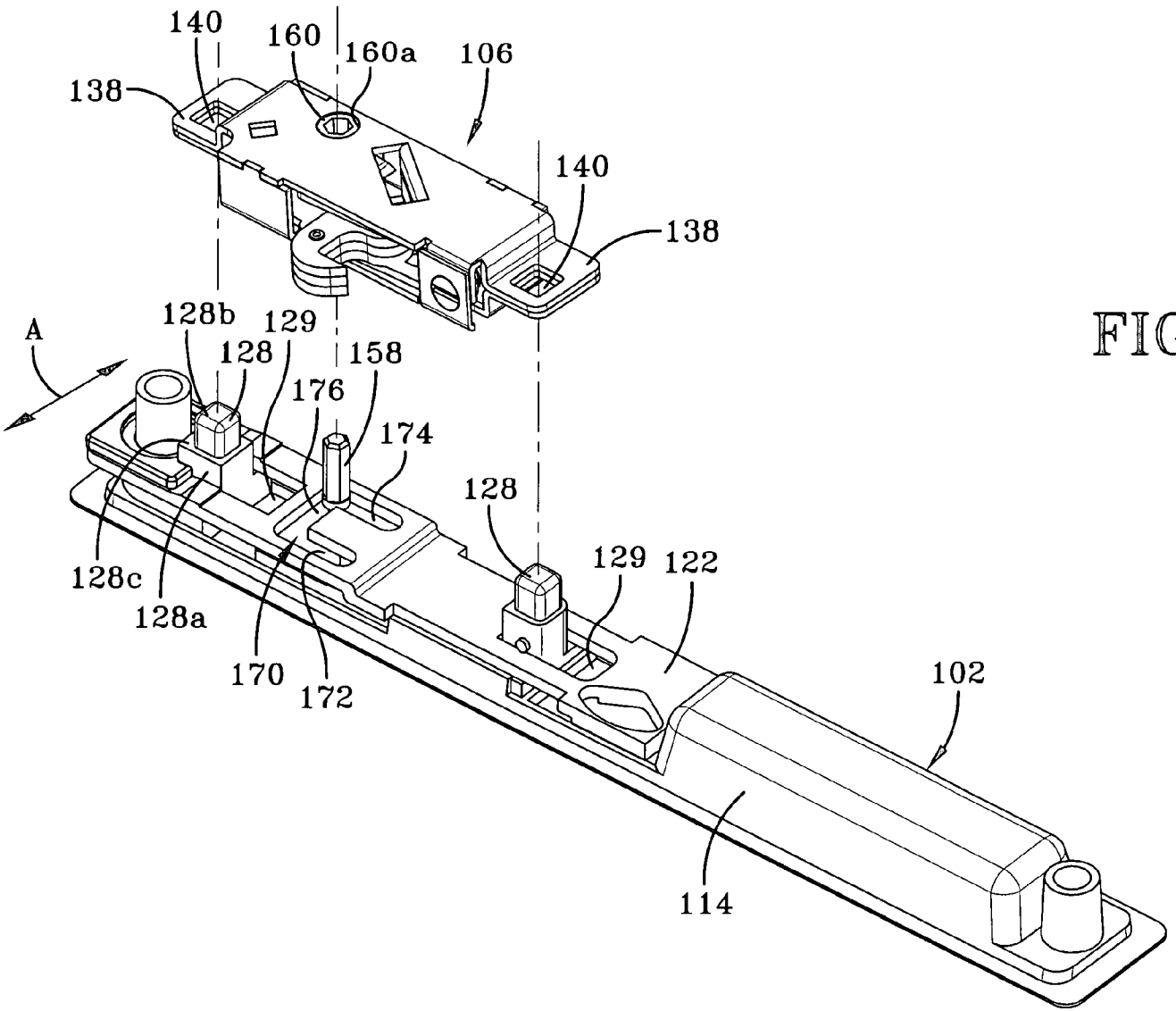
FIG. 7A is a perspective view of one embodiment of the lock assembly of the present invention as shown in FIG. 3.
Figure 7B:
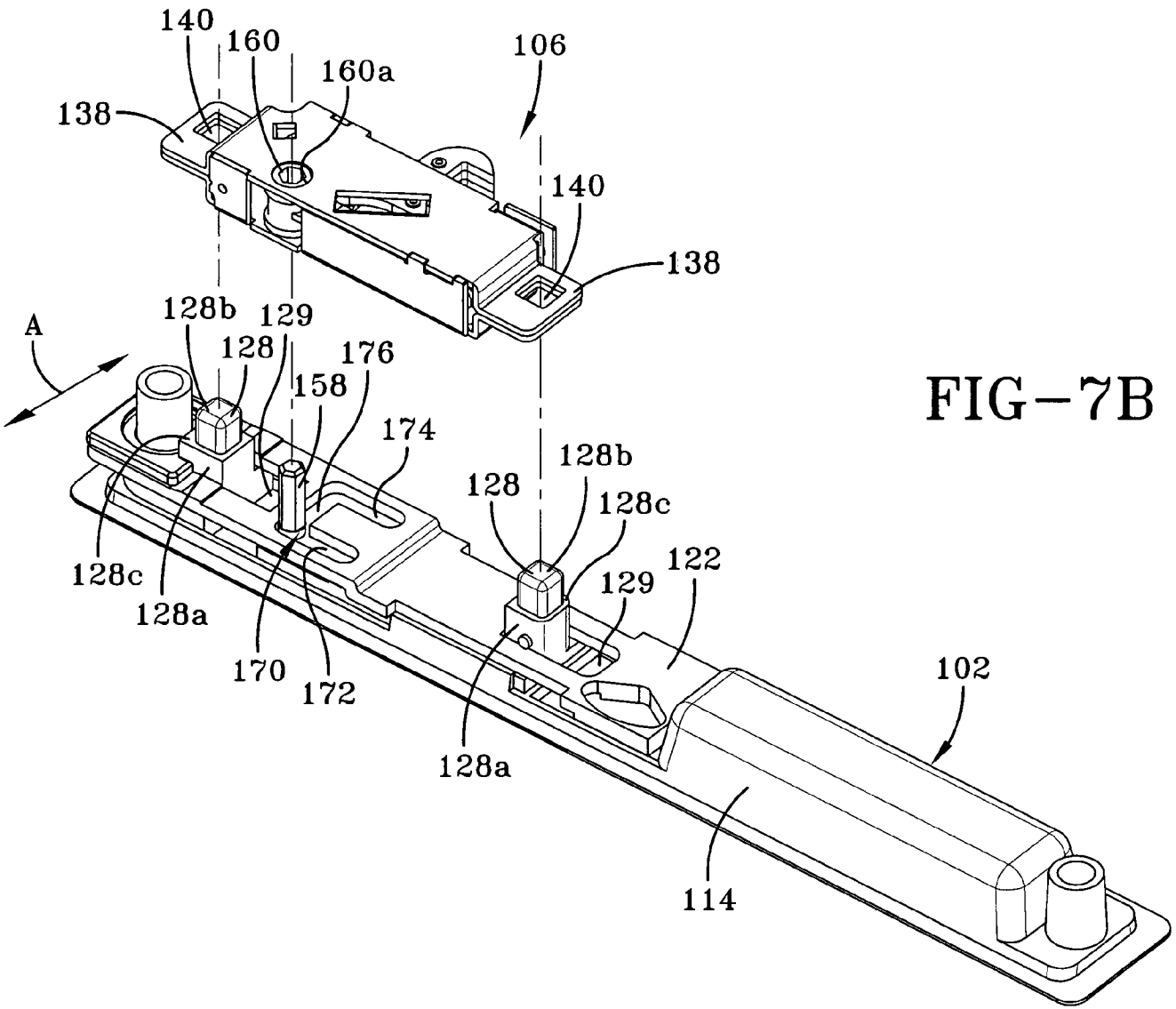
FIG. 7B is a perspective view of a second embodiment of the lock assembly of the present invention as shown in FIG. 3.
Figure 8:
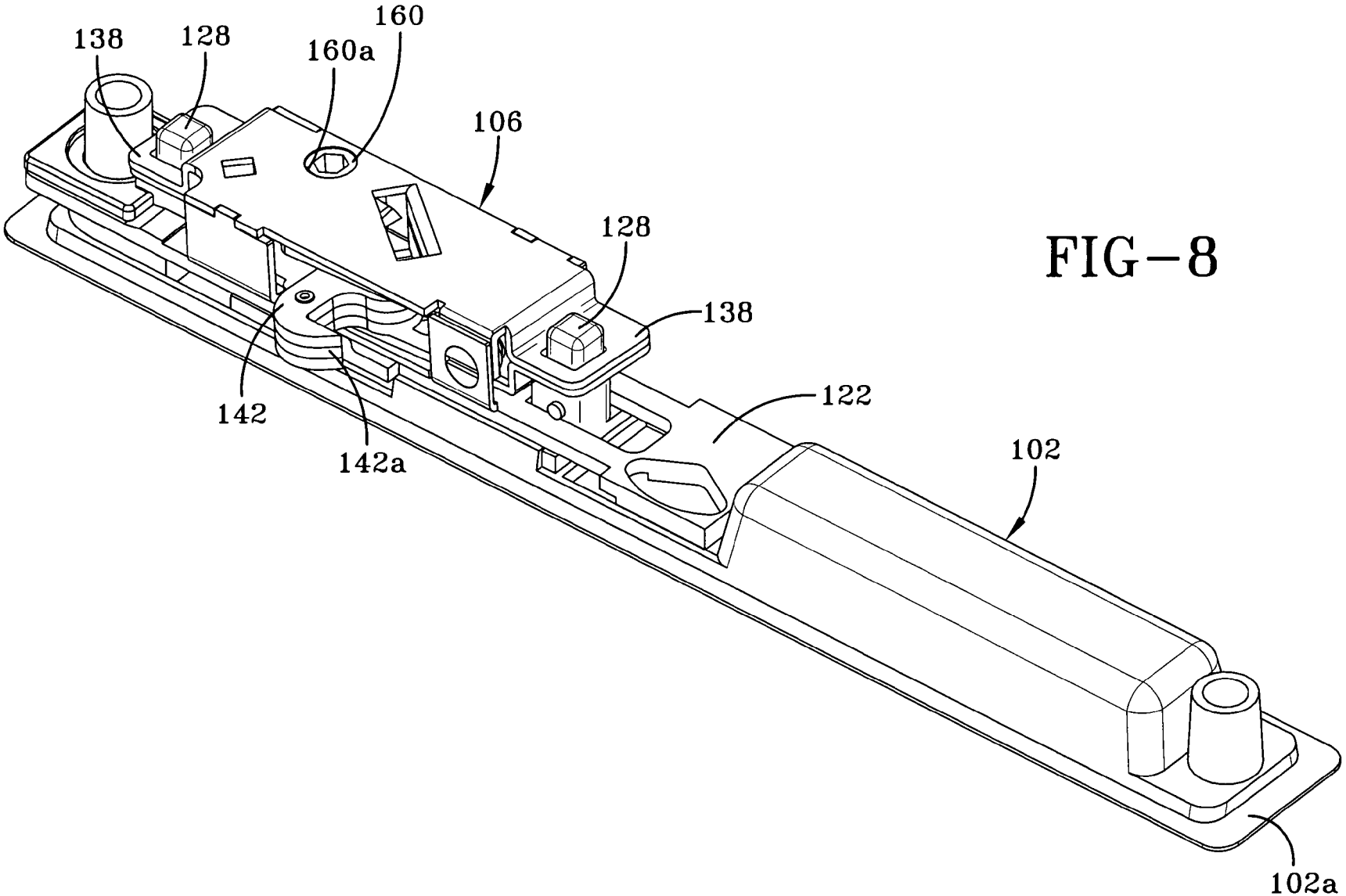
FIG. 8 is a perspective view of the lock assembly of the present invention as shown in FIG. 3.

Referring now to FIGS. 7A, 7B and 8, the securing arrangement of mortise lock 106 onto interior escutcheon 102 is shown and described. It should be appreciated that mortise lock 106 is a non-handed mortise lock. In other words, mortise lock 106 is employable in the form of either of two embodiments, one embodiment being with a left-handed latch (FIG. 7A) and the second embodiment being with a right-handed latch (FIG. 7B).

Referring first to FIG. 7A, mortise lock 106 is shown and described as secured to a right-handed interior escutcheon (latch) 102. It should be appreciated that the components of interior escutcheon 102 are substantially identical whether interior escutcheon 102 is right-handed or left-handed. Interior escutcheon 102 comprises vertical slider piece 122 movably affixed to interior escutcheon 102 at interior facing 114 and two opposing stationary securing posts 128. Securing posts 128 both include a base portion 128*a* having a width and an upper portion 128*b* having a width smaller than that of base portion 128*a* to form a support seat 128*c* for supporting mortise lock 106. During operation, mortise lock 106 is secured to securing posts 128 by inserting securing posts 128 through holes 140. In turn, flanges 138 rest on seats 128*c*.

Figure 12:
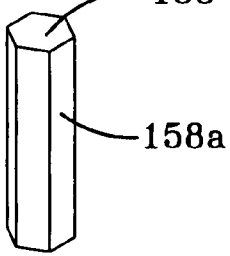
FIG. 12 is a perspective view of a spindle device for use with the lock assembly of the present invention as shown in FIG. 3.

Vertical slide 122 further includes two opposing guide spaces 129 which fit over securing posts 128 and allow securing posts 128 to extend through vertical slide 122. Interior escutcheon 102 also includes a six-sided rotational and movable actuator, or spindle 158 (FIGS. 7A, 7B and 12) extending outwardly from interior escutcheon interior facing 114. Spindle 158 is in mechanical communication with mortise lock 106 and is movable in a horizontal direction along the width of interior escutcheon 102, as indicated by directional arrow "A" and between a left-handed position (FIG. 7A) and a right-handed position (FIG. 7B). In each position, spindle 158 may be lockably secured in place by a locking mechanism (not shown), such as a snap-lock, to prevent inadvertent or unnecessary horizontal movement of spindle 158. Interior escutcheon 102 further includes a spindle track 170 having a first vertical portion 172, a second vertical portion 174 and a horizontal portion 176. Horizontal portion 176 of track 170 defines the horizontal movement of spindle 158 on interior escutcheon 102 between the left-handed position and the right-handed position along direction A. Vertical portions 172, 174 allow for movement of slider piece 11 relative to spindle 158. In other words, vertical portions 172, 174 allow slider piece 122 to move vertically along interior escutcheon 102 without being obstructed by spindle 158. Vertical portions 172, 174 also engage spindle 158, such as in a manner corresponding to the six-sided arrangement of spindle 158. The movement of slider piece 122 moves either vertical portion 172, 174 (depending on whether a right-handed or left-handed latch is being used) relative to spindle 158 to rotate spindle 158 in a clockwise or counter-clockwise direction accordingly.

As mentioned above, a six-sided drive shaft 160 (FIG. 8) is provided through housing 107 and includes accessible opening 160*a* on each side of mortise lock 106 (as explained earlier). Accessible opening 160*a* (FIGS. 7A, 7B, 8) provides an access point for spindle 158 into mortise lock 106 to facilitate the mechanical communication between spindle 158 and mortise lock 106 and for operation of mortise lock 106, as explained in further detail below.

Mortise lock 106 is securable onto interior escutcheon 102 by placing mortise lock 106 onto interior escutcheon interior facing 114 such that holes 140 of opposing flanges 138 of mortise lock 106 are aligned with opposing securing posts 128 (FIG. 8), as explained above. It should be appreciated that opposing securing posts 128 are distanced from each other at a distance that is the same as the distance between opposing holes 140 and that securing posts 128 and holes 140 have corresponding rectangular shapes to facilitate the engagement between securing posts 128 and holes 140; however, securing posts 128 and holes 140 can have alternative corresponding shapes. When mortise lock 106 is secured onto interior escutcheon 102, securing posts 128 receive opposing flanges 138 by the engagement between holes 140 and securing posts 128. In turn, drive shaft 160 of mortise lock 106 is aligned with and receives spindle 158 in a six-sided engagement, the six-sided shape of drive shaft 160 corresponding to the six-sided shape of spindle 158. During operation of assembly 100 (i.e., upwardly or downwardly vertical movement of slider piece 122), spindle 158 contacts drive shaft 160 which is operatively connected to locking element 142 via a drive assembly (not shown) which affects movement of locking element 142. Mortise lock 106 is thereby secured onto interior escutcheon 102 in a flush manner.

For application of mortise lock 106 onto a right-handed interior escutcheon 102 (FIG. 7B), spindle 158 is manually moved from the left-handed position on interior escutcheon 102 (FIG. 7A) to the right-handed position on interior escutcheon 102 (FIG. 7B) along horizontal portion 176 of track 170. Mortise lock 106 is subsequently flipped-over such that spindle 158 and drive shaft 160 remain aligned. Mortise lock 106 is secured onto interior escutcheon 102 in the manner described above.

Figure 9B:
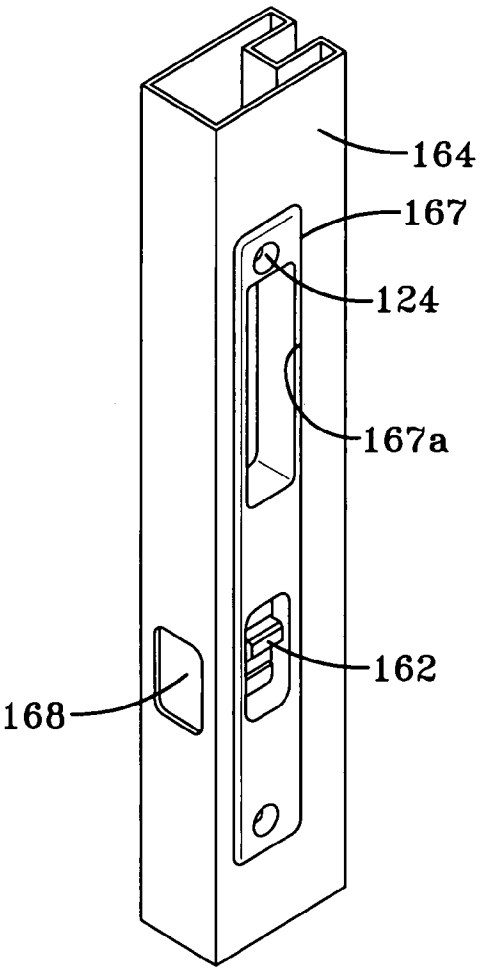
FIG. 9B is a perspective view of the fitting between the interior escutcheon of the lock assembly of the present invention as shown in FIG. 3 and a door stile.
Figure 9A:
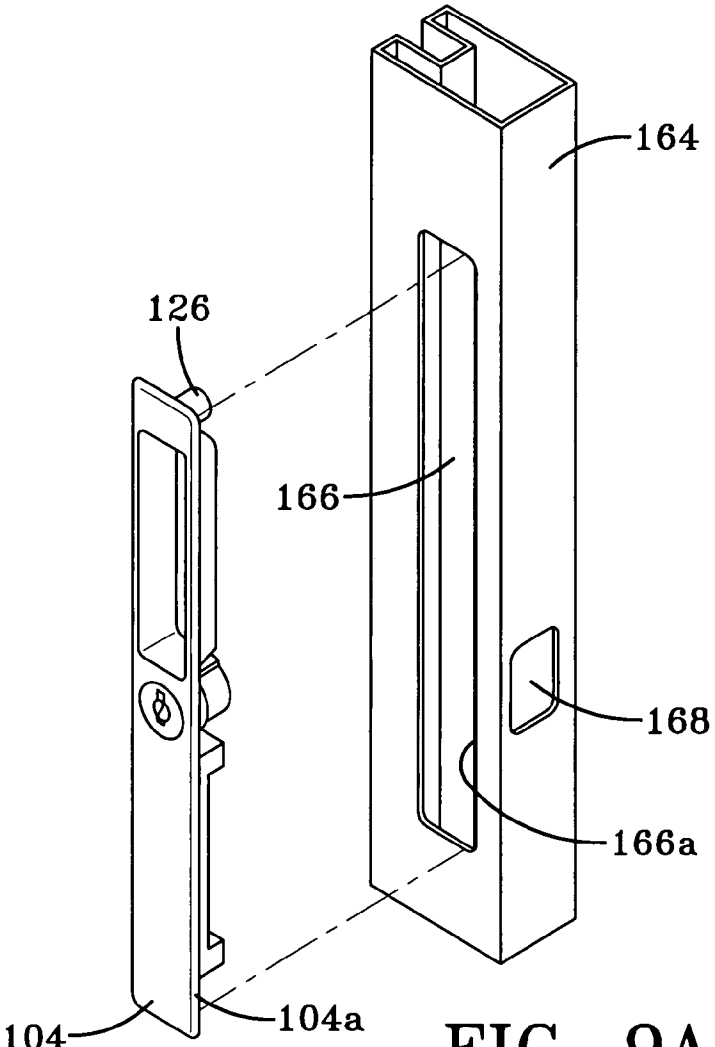
FIG. 9A is a perspective and partially exploded view of the fitting between the exterior escutcheon of the lock assembly of the present invention as shown in FIG. 3 and a door stile.
Figure 10B:
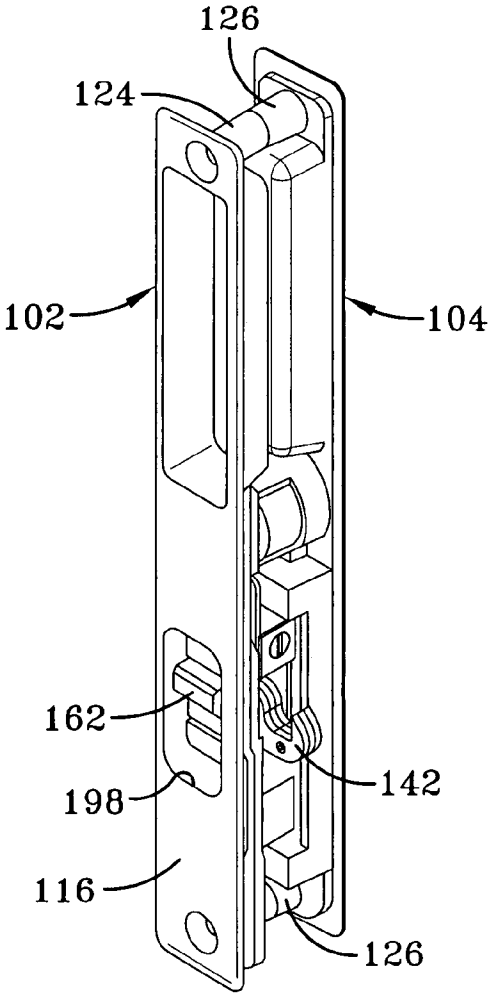
FIG. 10B is a perspective, interior view showing the operation of the lock assembly of the present invention as shown in FIG. 3.
Figure 11B:
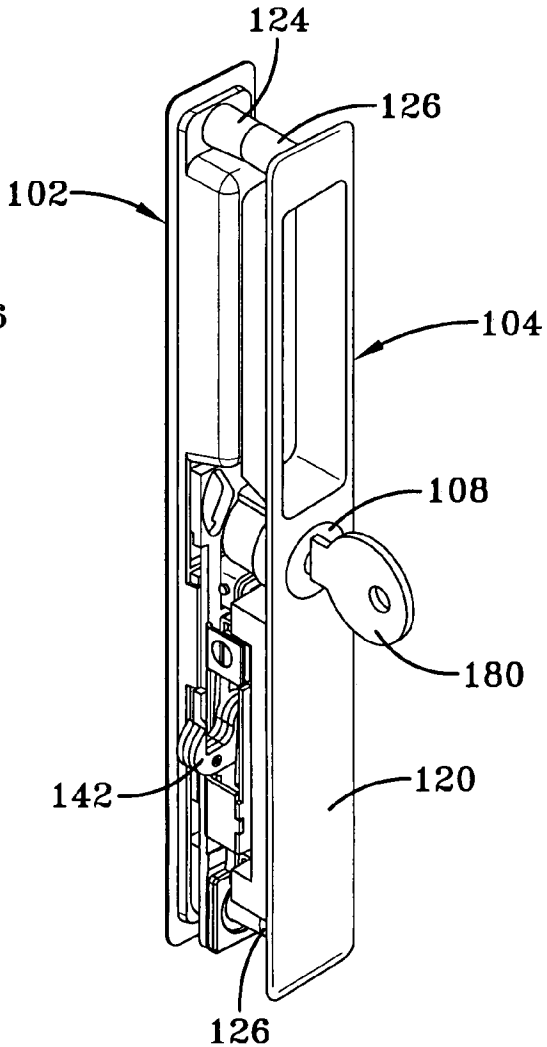
FIG. 11B is a perspective, exterior view showing the operation of the lock assembly of the present invention as shown in FIG. 3.

Turning now to FIGS. 9A and 9B, the placement of assembly 100 relative to a door stile 164 is shown and described. Door stile 164 includes an exterior cut-out portion 166 (FIG. 9A) and an interior cut-out portion 167 (FIG. 9B) for receiving assembly 100. Specifically, cut-out portions 166 and 167 include an edge 166*a* and 167*a*, respectively, around the periphery of cut-out portions 166 and 167. Exterior escutcheon 104 includes an edge 104*a* around the periphery of exterior escutcheon 104 and an edge 102*a* surrounds the periphery of interior escutcheon 102. Exterior escutcheon 104 is secured onto door stile 164 by placing exterior escutcheon 104 into cut-out portion 166 such that edge 104*a* corresponds to and abuts against edge 166*a* in a flush arrangement and interior escutcheon 102 is secured onto door stile 164 by placing interior escutcheon 102 into cut-out portion 167 such that edge 102*a* corresponds to and abuts against edge 167*a* in a flush arrangement. In turn, exterior escutcheon 104 is secured to interior escutcheon 102 inside door stile 164 to secure assembly 100 to door stile 164 by two pairs of corresponding cylinders 124 and 126 on interior escutcheon 102 and exterior escutcheon 104, respectively (FIGS. 3, 10B and 11B). Door stile 164 further includes an access space 168 for providing access to locking element 142 for movement, thereby facilitating the securing of locking element 142 to keeper assembly 113. When assembly 100 is in place and locked in place with keeper assembly 113, locking element 142 extends outwardly from mortise lock 106 through access space 168.

Figure 10A:
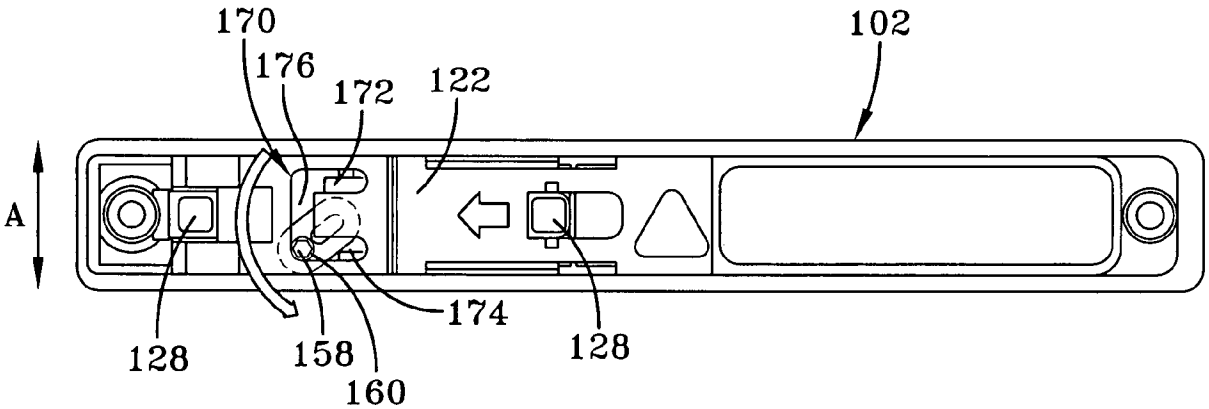
FIG. 10A is a front, interior view showing the operation of the lock assembly of the present invention as shown in FIG. 3.

Referring now to FIGS. 10A and 10B, the operation of mortise lock 106 from the inside is shown and described. As shown in FIG. 10B, slider piece 122 further includes an accessible knob 162 for affecting movement of slider piece 122. Exterior facing 116 of interior escutcheon 102 includes an access opening 198 for providing a user with access to accessible knob 162. Access opening 198 is substantially oval-shaped; however, it should be appreciated that access opening 198 may have any shape conventional in the art. Accessible knob 162 is directly secured to slider piece 122 and the manual movement of knob 162 in either an upward or downward direction causes the movement of slider piece 122 in the same upwardly or downwardly direction. Upwardly or downwardly movement of slider piece 122 in turn causes the locking or unlocking of mortise lock 106, as explained below.

In order to operate mortise lock 106 from the inside, the user manipulates knob 162 either upwardly or downwardly, as shown in FIG. 10B. In this instance, mortise lock 106 is shown in a locked position with locking element 142 activated and extended. By pushing knob 162 downwardly, the movement of slider piece 122 is affected in the same direction and locking element 142 retracts back into mortise lock 106, thereby unlocking assembly 100. As shown in FIG. 10A, drive shaft 160 is in contact around spindle 158 and is in mechanical communication with locking element 142. Upon movement of slider piece 122 by a user who is manually moving accessible knob 162, slider piece 122 moves upwardly or downwardly depending on whether assembly 100 is being locked or unlocked. In the case of moving slider piece 122 downwardly, as shown in FIGS. 10A and 10B, spindle 158 rotates counterclockwise as shown by the curved arrow in response to the movement of vertical portion 174 against spindle 158, spindle 158 being biased in position to prevent unwanted horizontal movement along directional line A. The rotational movement of spindle 158 causes the rotation of drive shaft 160 via the drive assembly (not shown), thereby causing locking element 142 to retract into mortise lock 106, in turn unlocking assembly 100. Alternatively, the upward movement of accessible knob 162 by the user causes the upward movement of slider piece 122 and causes the rotational movement of spindle 158 in an opposite direction or counter-rotational direction. This rotates drive shaft 160 in an opposite direction and extends locking element 142 out of mortise lock 106, thereby locking assembly 100.

Figure 11A:
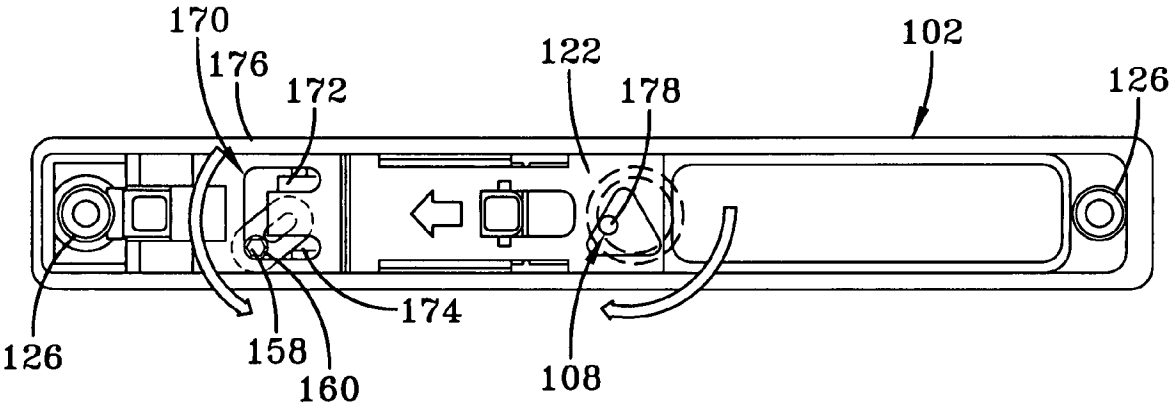
FIG. 11A is a front, exterior view showing the operation of the lock assembly of the present invention as shown in FIG. 3.

Referring now to FIGS. 11A and 11B, the operation of mortise lock 106 from the outside is shown and described. As shown in FIG. 11B, slider piece 122 is in mechanical communication with key cylinder 108 which is accessible through exterior facing 120 of exterior escutcheon 104. Key cylinder 108 includes a cylinder pin 178 operatively connected to slider piece 122. The locking and unlocking of mortise lock 106 from the outside is caused by a user turning key cylinder 108 by way of a corresponding key 180. Turning key 180 in a locking direction causes slider piece 122 to move in a locking direction (i.e., upwardly), thereby causing spindle 158 to rotate counterclockwise in response to the movement of vertical portion 174 against spindle 158. The rotation of spindle 158 rotates drive shaft 160 and effectively causes locking element 142 to rotate clockwise to extend from mortise lock 106 and lock assembly 100. The turning of key 180 in key cylinder 108 in the opposite direction, i.e., in an unlocking direction, causes slider piece 122 to move in an unlocking direction (i.e., downwardly). The movement of vertical portion 174 against spindle 158 rotates spindle 158 in a counter-rotational direction. The counter-rotational movement of spindle 158 rotates drive shaft in a counter-rotational direction causing locking element 142 to retract back into mortise lock 106 and unlock assembly 100.

An additional advantage of mortise lock 106 is locking element 142 being a retractable locking element 142 when locking element 142 is in an extended or locked position, but the door is ajar or open and not securely closed. In this instance, a user may close the door forcing locking element 142 to undesirably jam against the adjacent keeper assembly 113. Locking element 142, upon contact with keeper assembly 113, retracts by pivoting back into accessible opening 184 of mortise lock 106 instead of remaining in the extended position. The automatic retraction of locking element 142 into mortise lock 106 prevents damage to mortise lock 106, locking element 142 or keeper assembly 113.

The invention has been described with particular reference to the preferred embodiments thereof, but it should be understood that variations and modifications within the spirit and scope of the invention may occur to those skilled in the art to which the invention pertains.

I claim:

1. A lock assembly comprising:

an interior escutcheon having an inner facing, an exterior protective facing and an access opening on said exterior facing providing access to said lock assembly for operating said lock assembly;

an exterior escutcheon having an interior facing, an exterior facing and a key cylinder access opening, said interior escutcheon and said exterior escutcheon being connectable;

a mortise lock assembly securable to said interior escutcheon and comprising a substantially rectangular-shaped mortise lock housing having an accessible opening, a rotatable, retractable locking element rotatable between an unlocking position wherein said locking element is retracted into said accessible opening, and a locking position wherein said locking element is extending outwardly from said accessible opening for entry into a keeper, and a drive assembly operatively connected to said rotatable, retractable locking element for operating said locking element; and an apparatus operatively connected to said mortise lock assembly for controlled movement of said locking element from said locking position in the keeper to said unlocking position and from said unlocking position to said locking position, said apparatus for controlled movement of said locking element comprising:

a rotatable spindle operatively connected to said drive assembly of said mortise lock assembly;

a slidable device in mechanical communication with said rotatable spindle, said slidable device including a track for enabling sliding of said slidable device for sliding with respect to said rotatable spindle for effecting movement of said locking element; and at least one accessible control device operatively connected with said slidable device for sliding said slidable device.

2. The lock assembly according to claim 1 and further comprising a securing apparatus for securing said mortise lock assembly to said interior escutcheon, said securing apparatus comprising at least one post extending from said inner facing of said interior escutcheon and at least one flange extending from said mortise lock housing, said at least one flange defining a mating hole for corresponding to and receiving said at least one post.

3. The lock assembly according to claim 2 wherein said securing apparatus comprises two opposing posts extending from said inner facing of said interior escutcheon and two opposing flanges extending from opposite ends of said mortise lock housing, said two opposing flanges each defining a mating hole for corresponding to and receiving said two opposing posts.

4. The lock assembly according to claim 1 wherein said drive assembly of said mortise lock assembly further comprises a drive shaft in said mortise lock housing for receiving said movable spindle to affect rotation of said locking element.

5. The lock assembly according to claim 4, wherein said drive shaft is a six-sided drive shaft and said movable spindle is a six-sided spindle, said drive shaft receiving said movable spindle in a six-sided engagement.

6. The lock assembly according to claim 1 wherein said rotatable spindle is movable relative to said track in response to the sliding of said slidable device and wherein said slidable device is slidable in response to manipulation of said at least one accessible control device.

7. The lock assembly according to claim 6, wherein said rotatable spindle is rotational around an axis, said spindle being rotational in response to the sliding of said slidable device wherein said track moves relative to said rotatable spindle in response to sliding of said slidable device.

8. The lock assembly according to claim 7, wherein rotation of said rotational spindle affects rotation of said drive shaft, the rotation of said drive shaft activating the movement of said locking element between said locking position and said unlocking position.

9. The lock assembly according to claim 1 wherein said at least one accessible control device comprises an interior accessible control device and an exterior accessible control device, said interior accessible control device being secured to said interior escutcheon and accessible through said interior escutcheon access opening and said exterior accessible control device is secured to said exterior escutcheon and is accessible through said exterior escutcheon access opening.

10. The lock assembly according to claim 9, wherein said interior accessible movement control device comprises a moveable knob operatively connected to said slidable device.

11. The lock assembly according to claim 9, wherein said exterior accessible movement control device comprises a key cylinder and a pin, said pin being operatively connected to said slidable device.

12. The lock assembly according to claim 1 and further comprising a keeper assembly comprising a receiving portion for receiving said locking element when said locking element extends outwardly from said mortise lock housing.

13. The lock assembly according to claim 12, wherein said keeper assembly comprises a keeper and a keeper's bracket securable to the other in a telescoping manner, said keeper and said keeper's bracket having corresponding configurations.

14. The lock assembly according to claim 12, wherein said locking element has a rotational path of movement, and said lock assembly further comprises an accessible opening in the path of said locking element, wherein said accessible opening receives said rotatable locking element from the locking position upon inadvertent contact with said keeper assembly, thereby preventing damage to said mortise lock assembly, said locking element or said keeper assembly.

* * * * *